US008123984B2

(12) United States Patent
Chen et al.

(10) Patent No.: US 8,123,984 B2
(45) Date of Patent: Feb. 28, 2012

(54) POSITIVE TEMPERATURE COEFFICIENT POLYMER COMPOSITION AND MATERIAL MADE THEREFROM

(75) Inventors: Jack Jih-Sang Chen, Taipei (TW); Chi-Hao Gu, Taipei (TW)

(73) Assignee: Fuzetec Technology Co., Ltd., Taipei County (TW)

( * ) Notice: Subject to any disclaimer, the term of this patent is extended or adjusted under 35 U.S.C. 154(b) by 367 days.

(21) Appl. No.: 12/431,267

(22) Filed: Apr. 28, 2009

(65) Prior Publication Data

US 2010/0200817 A1 Aug. 12, 2010

(30) Foreign Application Priority Data

Feb. 10, 2009 (TW) ..... 98104179 A

(51) Int. Cl.
*H01B 1/06* (2006.01)
*H01B 1/24* (2006.01)

(52) U.S. Cl. ..... 252/511; 252/500; 252/502; 252/512; 264/105; 264/330; 338/22 R; 524/47; 524/495

(58) Field of Classification Search ..... 252/500, 252/511, 502, 512; 524/47, 495; 264/105, 264/330; 338/22 R
See application file for complete search history.

(56) References Cited

U.S. PATENT DOCUMENTS

| | | | | |
|---|---|---|---|---|
| 5,247,276 | A * | 9/1993 | Yamazaki | 338/22 R |
| 5,714,096 | A * | 2/1998 | Dorfman | 252/511 |
| 6,828,362 | B1 * | 12/2004 | Lee et al. | 524/47 |
| 7,041,238 | B2 * | 5/2006 | Kim et al. | 252/511 |
| 2004/0232387 | A1 * | 11/2004 | Kim et al. | 252/500 |

* cited by examiner

*Primary Examiner* — Khanh Tuan Nguyen
(74) *Attorney, Agent, or Firm* — Stephen A. Bent; Foley & Lardner LLP

(57) ABSTRACT

A positive temperature coefficient polymer composition includes a polymer system and a conductive particulate filler. The polymer system includes a non-ionic copolymer of a substituted or non-substituted olefin monomer and an anhydride monomer. The olefin monomer and the anhydride monomer form a linear polymer chain.

8 Claims, No Drawings

POSITIVE TEMPERATURE COEFFICIENT POLYMER COMPOSITION AND MATERIAL MADE THEREFROM

CROSS-REFERENCE TO RELATED APPLICATION

This application claims priority of Taiwanese Application No. 098104179, filed on Feb. 10, 2009.

BACKGROUND OF THE INVENTION

1. Field of the Invention

This invention relates to a positive temperature coefficient (PTC) polymer composition and a material made therefrom, more particularly to a PTC conductive polymer composition comprising a non-ionic copolymer of a substituted or non-substituted olefin monomer and an anhydride monomer.

2. Description of the Related Art

A positive temperature coefficient (PTC) element exhibits a PTC effect that renders the same to be useful as a protecting device, such as a fuse. The PTC element includes a PTC polymer material and first and second electrodes formed on two opposite surfaces of the PTC polymer material. The PTC polymer material includes a polymer matrix that contains a crystalline region and a non-crystalline region, and a conductive particulate filler that is dispersed in the non-crystalline region of the polymer matrix and that is formed into a continuous conductive path for electrical conduction between the first and second electrodes. The PTC effect is a phenomenon that when the temperature of the polymer matrix is raised to its melting point, crystals in the crystalline region start melting, which results in generation of a new non-crystalline region. As the new non-crystalline region is increased to an extent to merge into the original non-crystalline region, the conductive path of the conductive particulate filler will become discontinuous and the resistance of the PTC polymer material will be sharply increased, thereby resulting in an electrical disconnection between the first and second electrodes.

The PTC element is required to have a high PTC effect, a high conductivity, and a high electrical stability. In addition, the polymer matrix of the PTC element is required to have a strong adhesion to the first and second electrodes.

Although the conductivity of the PTC polymer material can be improved by increasing the amount of the conductive particulate filler, the PTC effect and the adhesion of the polymer matrix to the first and second electrodes are decreased correspondingly.

It has been proposed in the art that the adhesion of the polymer matrix to the first and second electrodes can be enhanced through the use of a grafted olefin polymer, such as maleic anhydride-grafted polyethylene. The maleic anhydride group of the grafted olefin polymer and the first and second electrodes form polar-polar interactions thereamong, thereby enhancing the adhesion of the polymer matrix to the first and second electrodes and preventing undesired peeling of the first and second electrodes from the polymer matrix. Although the polymer matrix containing the grafted polymer can provide the aforementioned advantage, it can result in a significant decrease in the conductivity of the PTC polymer material.

SUMMARY OF THE INVENTION

Therefore, an object of the present invention is to provide a PTC polymer composition that can provide the aforementioned advantage attributed to the inclusion of the grafted polymer in the polymer matrix of the conventional PTC polymer material, and a higher conductivity than that of the conventional PTC polymer material containing the grafted polymer.

According to one aspect of this invention, there is provided a PTC polymer composition that comprises: a polymer system and a conductive particulate filler. The polymer system comprises a non-ionic copolymer of a substituted or non-substituted olefin monomer and an anhydride monomer. The olefin monomer and the anhydride monomer form a linear polymer chain.

According to another aspect of this invention, there is provided a PTC polymer material that comprises a polymer matrix and a conductive particulate filler dispersed in the polymer matrix. The polymer matrix is made from a polymer system. The polymer system comprises a non-ionic copolymer of a substituted or non-substituted olefin monomer and an anhydride monomer. The olefin monomer and the anhydride monomer form a linear polymer chain. The anhydride monomer and the conductive particulate filler form a polar-polar interaction therebetween.

DETAILED DESCRIPTION OF THE PREFERRED EMBODIMENTS

The present invention relates to a PTC conductive polymer composition including a polymer system and a conductive particulate filler, and to a PTC conductive polymer material made from the PTC conductive polymer composition through compounding techniques. The PTC conductive polymer material thus formed includes a polymer matrix and a conductive particulate filler dispersed in the polymer matrix. The polymer system includes anon-ionic copolymer of a substituted or non-substituted olefin monomer and an anhydride monomer. The olefin monomer and the anhydride monomer form a linear polymer chain. The anhydride monomer and the conductive particulate filler in the polymer matrix form a polar-polar interaction therebetween.

Preferably, the anhydride monomer is selected from the group consisting of maleic anhydride, succinic anhydride, glutaric anhydride, and combinations thereof.

Preferably, the substituted or non-substituted olefin monomer of the non-ionic copolymer is selected from the group consisting of ethylene, propylene, and the combination thereof.

Preferably, the non-ionic copolymer further contains an acrylate monomer. More preferably, the non-ionic copolymer is a trimer selected from the group consisting of ethylene/ethyl acrylate/maleic anhydride trimer, ethylene/ethyl acrylate/succinic anhydride trimer, ethylene/ethyl acrylate/glutaric anhydride trimer, ethylene/butyl acrylate/maleic anhydride trimer, ethylene/butyl acrylate/succinic anhydride trimer, ethylene/butyl acrylate/glutaric anhydride trimer, and combinations thereof.

Preferably, the polymer system further includes a crystalline polymer having a crystallinity higher than that of the non-ionic copolymer.

Preferably, the crystalline polymer is selected from the group consisting of non-grafted high density polyethylene, non-grafted low density polyethylene, non-grafted ultra-low density polyethylene, non-grafted middle density polyethylene, non-grafted polypropylene, and combinations thereof. Preferably, the melting point of the crystalline polymer is higher than 125° C. In one preferred embodiment, the melting point of the crystalline polymer is about 130° C.

Preferably, the weight ratio of the crystalline polymer to the non-ionic copolymer ranges from 9:1 to 1:9. More preferably, the weight ratio of the crystalline polymer to the non-ionic copolymer ranges from 9:1 to 1:3.

Preferably, the weight ratio of the polymer system to the conductive particulate filler ranges from 2:1 to 1:4. More preferably, the weight ratio of the polymer system to the conductive particulate filler ranges from 1.5:1 to 1:2.

In some preferred embodiments, the conductive particulate filler is a carbon powder. In other preferred embodiments, the conductive particulate filler is a non-carbon conductive powder. Preferably, the non-carbon conductive powder is selected from the group consisting of a metal powder, a ceramic powder, a surface metallized non-metallic powder, and combinations thereof.

The following examples and comparative examples are provided to illustrate the preferred embodiments of the invention, and should not be construed as limiting the scope of the invention.

EXAMPLE

Example 1

E1

45 grams of the ethylene/maleic anhydride copolymer (PE/MA copolymer) (trade name: EC-603D®, MA content: 1.0 wt %, m.p.: 105° C., purchased from DuPont) and 55 grams of a carbon powder (trade name: Raven 403UB®, purchased from Columbian Chemicals Company) were compounded in a Brabender mixer. The compounding temperature was 200° C., the stirring rate was 50 rpm, and the compounding time was 4 minutes. The compounded mixture was placed in a Plaque mold (thin plate having a length of 75 mm, a width of 64 mm and a thickness of 18 mm) provided with two copper wires therein. Then, the Plaque sample was hot pressed using a hot pressing machine. The hot pressing temperature was 200° C., the hot pressing time was 4 minutes, and the hot pressing pressure was 80 kg/cm$^2$. Subsequently, the resistance of the hot pressed Plaque sample was determined (as shown in Table 1).

Examples 2-4

E2-E4

The procedures and conditions in preparing Plaque samples of Examples 2-4 (E2-E4) were similar to those of Example 1, except that the concentrations of the ethylene/maleic anhydride copolymer of Examples 2-4 were different from that of Example 1 (as shown in Table 1).

Examples 5-8

E5-E8

The procedures and conditions in preparing Plaque samples of Examples 5-8 (E5-E8) were similar to those of Example 1, except that in Examples 5-8, ethylene/butyl acrylate/maleic anhydride trimer (PE/BA/MA) (trade name: Lotarder 3410®, BA content: 18.0 wt %, MA content: 3.1 wt %, m.p.: 91° C., purchased from Arkema Inc) was used to replace ethylene/maleic anhydride copolymer used in Example 1, and the concentrations of the ethylene/butyl acrylate/maleic anhydride trimer of Examples 5-8 corresponded to those of Examples 1-4, respectively (as shown in Table 1).

Examples 9-12

E9-E12

The procedures and conditions in preparing Plaque samples of Examples 9-12 (E9-E12) were similar to those of Example 1, except that in Examples 9-12, ethylene/ethyl acrylate/maleic anhydride trimer (PE/EA/MA) (trade name: Lotarder 3300®, EA content: 8.4 wt %, MA content: 3.1 wt %, m.p.: 98° C., purchased from Arkema Inc) was used to replace ethylene/maleic anhydride copolymer used in Example 1, and the concentrations of the ethylene/ethyl acrylate/maleic anhydride trimer of Examples 9-12 corresponded to those of Examples 1-4, respectively (as shown in Table 1).

Comparative Examples 1-4

CE1-CE4

The procedures and conditions in preparing Plaque samples of Comparative Examples 1-4 (CE1-CE4) were similar to those of Example 1, except that in Comparative Examples 1-4, maleic anhydride-grafted polyethylene (MA-Grafted PE) (trade name: MB100D®, MA content: 1.0 wt %, m.p.: 135° C., purchased from DuPont) was used to replace ethylene/maleic anhydride copolymer used in Example 1, and the concentrations of the maleic anhydride-grafted polyethylene of Comparative Examples 1-4 corresponded to those of Examples 1-4, respectively (as shown in Table 1).

Comparative Examples 5-8

CE5-CE8

The procedures and conditions in preparing Plaque samples of Comparative Examples 5-8 (CE5-CE8) were similar to those of Example 1, except that in Comparative Examples 5-8, sodium ionic copolymer of ethylene/methacrylic acid (Ionic Co-PE/MA) (trade name: Surlyn 8670®, copolymer of sodium ions and ethylene/methacrylic acid polymer, m.p.: 90° C., purchased from DuPont) was used to replace ethylene/maleic anhydride copolymer, and the concentrations of the sodium ionic copolymer of ethylene/methacrylic acid of Comparative Examples 5-8 corresponded to those of Examples 1-4, respectively (as shown in Table 1).

TABLE 1

| | Polymer system | | | Plaque |
|---|---|---|---|---|
| | Polymer | Weight (wt %) | Carbon powder Weight (wt %) | Resistance (ohm) |
| E1 | Co-PE/MA | 35 | 65 | 0.0445 |
| E2 | Co-PE/MA | 45 | 55 | 0.0524 |
| E3 | Co-PE/MA | 50 | 50 | 0.1436 |
| E4 | Co-PE/MA | 60 | 40 | 2.2008 |
| E5 | Co-PE/BA/MA | 35 | 65 | 0.0478 |
| E6 | Co-PE/BA/MA | 45 | 55 | 0.0514 |
| E7 | Co-PE/BA/MA | 50 | 50 | 0.1696 |
| E8 | Co-PE/BA/MA | 60 | 40 | 2.3644 |
| E9 | Co-PE/EA/MA | 35 | 65 | 0.0538 |
| E10 | Co-PE/EA/MA | 45 | 55 | 0.0605 |
| E11 | Co-PE/EA/MA | 50 | 50 | 0.2118 |
| E12 | Co-PE/EA/MA | 60 | 40 | 3.2670 |
| CE1 | MA-Grafted PE | 35 | 65 | 0.0740 |
| CE2 | MA-Grafted PE | 45 | 55 | 0.0814 |

TABLE 1-continued

| | Polymer system | | | Plaque |
|---|---|---|---|---|
| | Polymer | Weight (wt %) | Carbon powder Weight (wt %) | Resistance (ohm) |
| CE3 | MA-Grafted PE | 50 | 50 | 0.2549 |
| CE4 | MA-Grafted PE | 60 | 40 | 4.3585 |
| CE5 | Ionic Co-PE/MA | 35 | 65 | 0.1144 |
| CE6 | Ionic Co-PE/MA | 45 | 55 | 0.1259 |
| CE7 | Ionic Co-PE/MA | 50 | 50 | 0.3956 |
| CE8 | Ionic Co-PE/MA | 60 | 40 | 7.7370 |

As shown in Table 1, the results show that the PTC polymer material of this invention containing a non-ionic copolymer of an olefin monomer and an anhydride monomer (E1-E12) has a lower resistance (i.e., a higher conductivity) than that of the conventional PTC polymer material containing a grafted polyolefin or an ionic copolymer (CE1-CE8).

Examples 13-15

E13-E15

The procedures and conditions in preparing Plaque samples of Examples 13-15 (E13-E15) were similar to those of Example 1, except that in Examples 13-15, a nickel powder (trade name: Type 240®, purchased from Inco Special Products) was used to replace the carbon powder used in Example 1, and the polymers used respectively in Examples 13-15 corresponded to those used in the three sets of Examples 1-4, 5-8, 9-12, respectively (as shown in Table 2).

Comparative Examples 9-10

CE9-CE10

The procedures and conditions in preparing Plaque samples of Comparative Examples 9-10 (CE9-CE10) were similar to those of Example 1, except that in Comparative Examples 9-10, a nickel powder was used to replace the carbon powder used in Example 1, and the polymers used respectively in Comparative Examples 9-10 were MA-Grafted PE and Ionic Co-PE-MA, respectively (as shown in Table 2).

The Plaque samples prepared in Examples E2, E6, E10, E13-15, and Comparative Examples CE2, CE6, and CE9-CE10 were subjected to a cycle test and an environment test. The test results are shown in Table 2. The cycle test was conducted by subjecting the test sample to a power of 20 Vdc and 100 A in a manner that the power was turned on for 60 seconds and then turned off for 60 seconds for each cycle to determine the cycle times that the test sample can endure without burning down. The results of the cycle test can be used to evaluate the electrical stability of withstanding tripping (i.e., conversion to the tripped state) for the test sample and thus the lifetime of the test sample, i.e., the greater the number of the cycle times, the greater will be the number of the trips the test sample can withstand, and the longer will be the lifetime of the test sample. The environment test was conducted by subjecting the test sample to an environment operated at a temperature of +60° C. and a humidity of 95% for 168 hours to determine the variation rate of the resistance of the test sample. The results of the environment test can be used to evaluate the resistance stability of Plaque samples, i.e., the smaller the variation rate of resistance, the more stable will be the plaque sample.

TABLE 2

| | Polymer system | | Conductive filler | | Cycle test | Environment test Variation rate of |
|---|---|---|---|---|---|---|
| | polymer | Weight (wt %) | kind | weight (wt %) | Cycle times | resistance (%) |
| E2 | Co-PE/MA | 45 | Carbon powder | 55 | >100 | 155 |
| E6 | Co-PE/BA/MA | 45 | Carbon powder | 55 | >100 | 146 |
| E10 | Co-PE/EA/MA | 45 | Carbon powder | 55 | >100 | 140 |
| E13 | Co-PE/MA | 20 | Nickel powder | 80 | >100 | 1659 |
| E14 | Co-PE/BA/MA | 20 | Nickel powder | 80 | >100 | 1769 |
| E15 | Co-PE/EA/MA | 20 | Nickel powder | 80 | >100 | 1899 |
| CE2 | MA-Grafted PE | 45 | Carbon powder | 55 | 24 | 155 |
| CE6 | Ionic Co-PE/MA | 45 | Carbon powder | 55 | 10 | 1620 |
| CE9 | MA-Grafted PE | 20 | Nickel powder | 80 | 10 | na (electrode peeled off) |
| CE10 | Ionic Co-PE/MA | 20 | Nickel powder | 80 | 3 | na (electrode peeled off) |

As shown in Table 2, the numbers of the cycle times of Examples E2, E6 and E10 are greater than those of Comparative Examples CE2 and CE6, and similar results are achieved for Examples E13~E15 as compared to Comparative Examples CE9 and CE10, which indicate that the PTC polymer material of this invention containing a non-ionic copolymer of an olefin monomer and an anhydride monomer has an improved resistance to tripping and an improved lifetime than those of the conventional PTC polymer material containing a grafted polyolefin or an ionic copolymer.

As for the results of the environment test, the variation rates of resistance of Examples E6 and E10 are lower than those of Comparative Examples CE2 and CE6, which indicate that the PTC polymer material having the trimer in the polymer system of this invention has an improved resistance stability than those of the conventional PTC polymer materials. In addition, none of the test samples of E2, E6, E10 and E13-15 encountered peeling of the electrodes as Comparative Examples CE9 and CE10 did, which indicates that the PTC polymer material of this invention has a higher adhesion to the electrodes than the conventional PTC polymer materials with metal powder as the conductive filler.

Examples 16-20

E16-E20

The procedures and conditions in preparing Plaque samples of Examples 16-20 (E16-20) were similar to those of Example 1, except that in Examples 16-20, the polymer system further includes a high density polyethylene (HDPE) The concentrations of the polymer of these examples are shown in Table 3.

TABLE 3

| Ex | Polymer system Copolymer | wt % | polyolefin | wt % | Carbon powder (wt %) | Plaque Resistance (ohm) |
|---|---|---|---|---|---|---|
| E16 | Co-PE/MA | 4.5 | HDPE | 40.5 | 55 | 0.0511 |
| E17 | Co-PE/MA | 11.25 | HDPE | 33.75 | 55 | 0.0508 |
| E18 | Co-PE/MA | 22.5 | HDPE | 22.5 | 55 | 0.0508 |
| E19 | Co-PE/MA | 33.75 | HDPE | 11.25 | 55 | 0.0515 |
| E20 | Co-PE/MA | 40.5 | HDPE | 4.5 | 55 | 0.0519 |

As shown in Tables 1 and 3, the PTC polymer materials of Examples 16-20 have a lower resistance, i.e., a higher conductivity, as compared to that of the PTC polymer material of Comparative Example CE2. As such, addition of crystalline polyolefin in the polymer system can enhance the conductivity of the PTC polymer material of this invention.

In conclusion, the PTC polymer material of the present invention not only has a better polar adhesive property, but also has a higher conductivity compared to the conventional PTC polymer material.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A positive temperature coefficient polymer composition comprising:

a polymer system comprising a non-ionic copolymer of a substituted or non-substituted olefin monomer and an anhydride monomer, said olefin monomer and said anhydride monomer forming a linear polymer chain; and a conductive particulate filler, wherein said non-ionic copolymer is a trimer selected from the group consisting of ethylene/ethyl acrylate/maleic anhydride and ethylene/butyl acrylate/maleic anhydride trimer.

2. The positive temperature coefficient polymer composition of claim 1, wherein said polymer system further comprises a crystalline polymer having a crystallinity higher than that of said non-ionic copolymer, and the weight ratio of said crystalline polymer to said non-ionic copolymer ranges from 9:1 to 1:9.

3. The positive temperature coefficient polymer composition of claim 2, wherein the melting point of said crystalline polymer is higher than 125° C.

4. The positive temperature coefficient polymer composition of claim 1, wherein the weight ratio of said polymer system to said conductive particulate filler ranges from 2:1 to 1:4.

5. The positive temperature coefficient polymer composition of claim 1, wherein said conductive particulate filler is a carbon powder.

6. The positive temperature coefficient polymer composition of claim 1, wherein said conductive particulate filler is a metal powder.

7. A positive temperature coefficient polymer material comprising:

a polymer matrix; and a conductive particulate filler dispersed in said polymer matrix, wherein said polymer matrix is made from a polymer system that comprises a non-ionic copolymer of a substituted or non-substituted olefin monomer and an anhydride monomer, said olefin monomer and said anhydride monomer forming a linear polymer chain, wherein said anhydride monomer and said conductive particulate filler in said polymer matrix form a polar-polar interaction therebetween, and wherein said non-ionic copolymer is a trimer selected from the group consisting of ethylene/ethyl acrylate/maleic anhydride trimer and ethylene/butyl acrylate/maleic anhydride trimer.

8. The positive temperature coefficient polymer material of claim 7, wherein said polymer system further comprises a crystalline polymer that has a crystallinity higher than that of said non-ionic copolymer.

* * * * *